US011839825B1

(12) United States Patent
Whelan

(10) Patent No.: US 11,839,825 B1
(45) Date of Patent: Dec. 12, 2023

(54) PORTABLE INDOOR-OUTDOOR BOARD GAME

(71) Applicant: Michael Whelan, Downingtown, PA (US)

(72) Inventor: Michael Whelan, Downingtown, PA (US)

( * ) Notice: Subject to any disclaimer, the term of this patent is extended or adjusted under 35 U.S.C. 154(b) by 250 days.

(21) Appl. No.: 17/479,205

(22) Filed: Sep. 20, 2021

(51) Int. Cl.

| | |
|---|---|
| ***A63F 7/02*** | (2006.01) |
| ***A63F 3/00*** | (2006.01) |
| ***A63F 7/30*** | (2006.01) |
| ***A63F 9/00*** | (2006.01) |
| ***A63F 7/00*** | (2006.01) |

(52) U.S. Cl.
CPC ..... *A63F 7/02* (2013.01); *A63F 3/00031* (2013.01); *A63F 7/30* (2013.01); *A63F 9/001* (2013.01); *A63F 2003/00034* (2013.01); *A63F 2007/0064* (2013.01); *A63F 2007/3005* (2013.01); *A63F 2009/0058* (2013.01)

(58) Field of Classification Search
CPC ..... A63F 7/02; A63F 3/00031; A63F 7/30; A63F 9/001; A63F 2003/00034; A63F 2007/0064; A63F 2007/3005; A63F 2009/0058
See application file for complete search history.

(56) References Cited

U.S. PATENT DOCUMENTS

| | | | | | |
|---|---|---|---|---|---|
| 524,475 | A * | 8/1894 | Wheeland | A63F 7/00 | 273/138.3 |
| 1,531,401 | A * | 3/1925 | Kawai | A63F 7/02 | 273/120 R |
| 1,947,772 | A * | 2/1934 | Harris | A63F 9/181 | 273/138.3 |
| 3,655,191 | A * | 4/1972 | Grant | A63F 9/0093 | 273/108 |
| 3,861,685 | A * | 1/1975 | Trbovich | A63F 7/02 | 124/16 |
| 3,951,412 | A * | 4/1976 | Adams | A63F 3/00082 | 273/246 |
| 5,080,592 | A * | 1/1992 | Laghi | G09B 23/02 | 434/188 |
| 6,279,903 | B1 * | 8/2001 | Mendes, Jr. | A63F 7/02 | 273/127 R |
| 9,999,829 | B1 * | 6/2018 | Fechser | A63F 3/00261 | |

* cited by examiner

*Primary Examiner* — Michael D Dennis
(74) *Attorney, Agent, or Firm* — Andrew L. Salvatore, Esquire

(57) ABSTRACT

The invention comprises a game with a playing surface containing cups for receiving balls thrown by a player. In the skill portion of the game, a player scores points by accurately throwing the balls into the cups. If the player misses any of the cups, in a chance portion of the game, the playing surface is sloped to direct the ball to fall into compartments which provide additional benefits or to incur penalties.
When playing the game with the baseball theme, a player may score runs by successfully throwing the ball into cups on the playing surface positioned at the first base, second base, third base, or home plate positions. Runners advancing past home plate score runs. Outs may be recorded for missing the cups. If the ball misses the cups, but falls into randomized compartments, the player may receive additional benefits or incur additional penalties.

12 Claims, 8 Drawing Sheets

PORTABLE INDOOR-OUTDOOR BOARD GAME

BACKGROUND OF THE INVENTION

Field of Invention

The invention relates to a portable indoor-outdoor board game which may be played in the comfort of one's home as well as at a remote location. In particular, attendance at sporting events is a popular and healthy pastime which draws people together to socialize and support athletic endeavors. In conjunction with attendance at sporting events, spectators and fans often arrive early to congregate and "tailgate." Tailgating involves eating, drinking, and general socialization and typically also includes playing games prior to the start of the sporting event. The invention provides for a gaming device and one or more methods of play for tailgaters to utilize during pre-game activities. The device of the invention may also be sports themed.

Description of the Prior Art

The prior art contains many examples of gaming devices. In some examples of gaming activities, the games are designed to measure the level of a person's skill. For instance, many prior art devices require a player to throw an object and strike another object for points. Other examples require a player to throw an object toward a hole or opening with the goal of accurately throwing the object into the opening to earn points. Such games of skill require a level of athleticism and hand eye coordination in order for the player to be successful.

Other prior art gaming devices focus, instead, on the element of chance and remove any element of skill for a determination of the outcome. Examples of such games of chance include throwing of dice in a game of craps or the release of a ball onto a roulette wheel which will ultimately settle by chance into one of typically 38 spaces. These games do not require any level of athleticism or coordination and instead leave the outcome to mathematical probability and sheer luck.

Prior art devices are, then, generally exclusive to either those who are athletically inclined or alternately, those who seek games whose outcome is determined primarily by chance. The devices of the prior art do not provide a means whereby these groups of people can interact together benefiting from their talents but also adding the element of chance to the game. The subject invention overcomes these limitations and provides a device and method whereby all players, those athletically skilled and those less athletically skilled, can interact and compete in a fun and enjoyable manner in virtually any setting.

SUMMARY OF THE INVENTION

The invention comprises a game with a playing surface 10 adapted to hold one or more cups 20 or receptables for receiving balls 30 thrown by a player. A player scores points by accurately throwing the balls into the cups. In this aspect of the game, the player strives to utilize his skill and effectively utilize hand eye coordination to accurately throw the balls into the cups from a distance. In a preferred embodiment, the surface may be enclosed on three sides to assist in keeping the balls in play if the player misses the cups and the ball bounces on the playing surface.

If the player misses any of the cups, the playing surface is sloped to direct the ball toward a dowel panel holder 100 at the front edge 15 of the playing surface 10 and under the playing surface. The dowel panel holder is positioned vertically and generally perpendicular to the playing surface. It comprises a plurality of pegs 110 alternately arranged between a front dowel panel 120 and the dowel panel holder 100 such that as a ball drops into the pegs, the ball moves in different directions as it strikes the pegs while falling. Deflectors 160 may assist to direct the ball back in the direction of the pegs. In a preferred embodiment, front dowel panel 120 is constructed of a transparent material such as glass or plexiglass such that the path of the travel of the ball is visible as it falls through the pegs 110 attached to the dowel panel holder 100.

At the bottom of the dowel panel holder is a compartmentalized tray 140. As a ball falls randomly through the pegs, it will fall into a compartment 150 in the tray, each compartment created and separated by dividers 145. In game play, each compartment in the tray also may provide consequences to the player, either awarding points or other benefits to the player or imposing a penalty on the player. Removeable and changeable compartment designations may be inserted at the bottom of each compartment to designate the award or penalty to a player if the ball falls into a particular compartment. A player's ability to receive benefits or incur penalties after the ball falls into the dowel panel holder is completely random, and in this aspect of the game, the results are determined by chance.

When playing the game with the baseball theme, a player may incur points (i.e. score runs) by successfully throwing the ball into cups on the playing surface positioned at the first base, second base, third base, or home plate positions. A runner may be marked in a corresponding position, for instance, first base if the cup landed in the first base cup designating a single. All runners preceding that runner may advance a corresponding number of bases. Outs may be recorded if the ball misses the cups or if the ball leaves the playing surface without falling into the chance portion of the game.

If the ball misses the cups and falls into the dowel panel holder to randomly distribute the ball into a compartment, the player may incur benefits, such as a single, double, triple, or home run, or additional outs. Once a player incurs a specified number of outs, play may pass to another player in an inning. Play may continue for predetermined number of innings with the winner being the player with the most runs after all innings have been played.

DETAILED DESCRIPTION OF THE INVENTION

Figure 1:
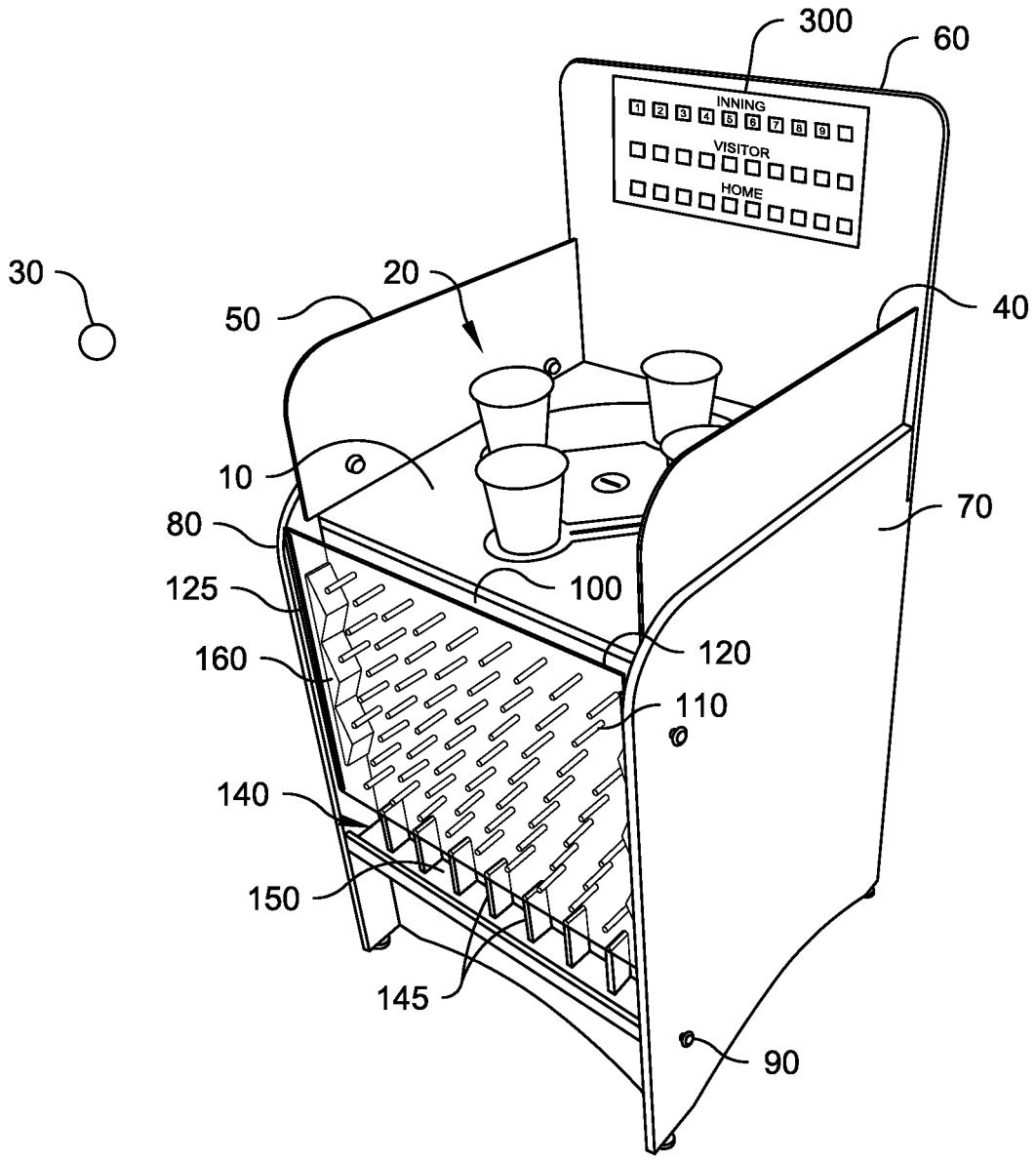
FIG. 1 shows a perspective view of a portable indoor-outdoor board game with baseball theme according to the invention.

The invention comprises a game with a playing surface 10 adapted to hold one or more cups 20 or receptables for receiving balls 30 thrown by a player. A player scores points by accurately throwing the balls into the cups. In this aspect of the game, the player strives to utilize his skill and effectively utilize hand eye coordination to accurately throw the balls into the cups from a distance. In a preferred embodiment, the surface may be enclosed on three sides to assist in keeping the balls in play if the player misses the cups and the ball bounces on the playing surface.

If the player misses any of the cups, the playing surface is sloped to direct the ball toward a dowel panel holder 100 at the front edge 15 of the playing surface 10 and under the playing surface. The dowel panel holder is positioned vertically and generally perpendicular to the playing surface. It comprises a plurality of pegs 110 alternately arranged between a front dowel panel 120 and the dowel panel holder 100 such that as a ball drops into the pegs, the ball moves in different directions as it strikes the pegs while falling. Deflectors 160 may assist to direct the ball back in the direction of the pegs. In a preferred embodiment, front dowel panel 120 is constructed of a transparent material such as glass or plexiglass such that the path of the travel of the ball is visible as it falls through the pegs 110 attached to the dowel panel holder 100. Further, in a preferred embodiment, the top edge of front dowel panel 120 may be raised above the level of playing surface 10 to assist in containing balls thrown toward the playing surface. Tracks 125 may be installed onto right side panel 70 and left side panel 80 to hold front dowel panel 120 and allow front dowel panel to be easily removed during disassembly of the game.

At the bottom of the dowel panel holder is a compartmentalized tray 140. As a ball falls randomly through the pegs, it will fall into a compartment 150 in the tray, each compartment created and separated by dividers 145. The tray 140 may also be hinged such that it can fold toward dowel panel holder 100 and make the components more compact with less moving parts during disassembly.

In game play, each compartment in the tray also may provide consequences to the player, either awarding points or other benefits to the player or imposing a penalty on the player. Removeable and changeable compartment designations may be inserted at the bottom of each compartment to designate the award or penalty to a player if the ball falls into a particular compartment. A player's ability to receive benefits or incur penalties after the ball falls into the dowel panel holder is completely random, and in this aspect of the game, the results are determined by chance.

Figure 2:
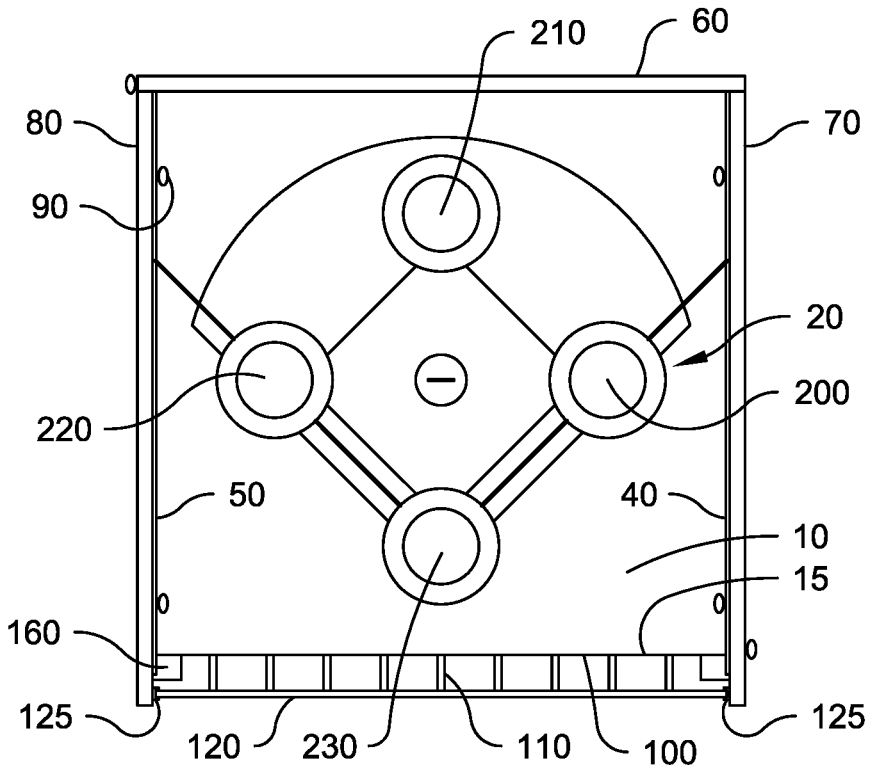
FIG. 2 shows a top plan view of a portable indoor-outdoor board game with baseball theme according to the invention.
Figure 3:
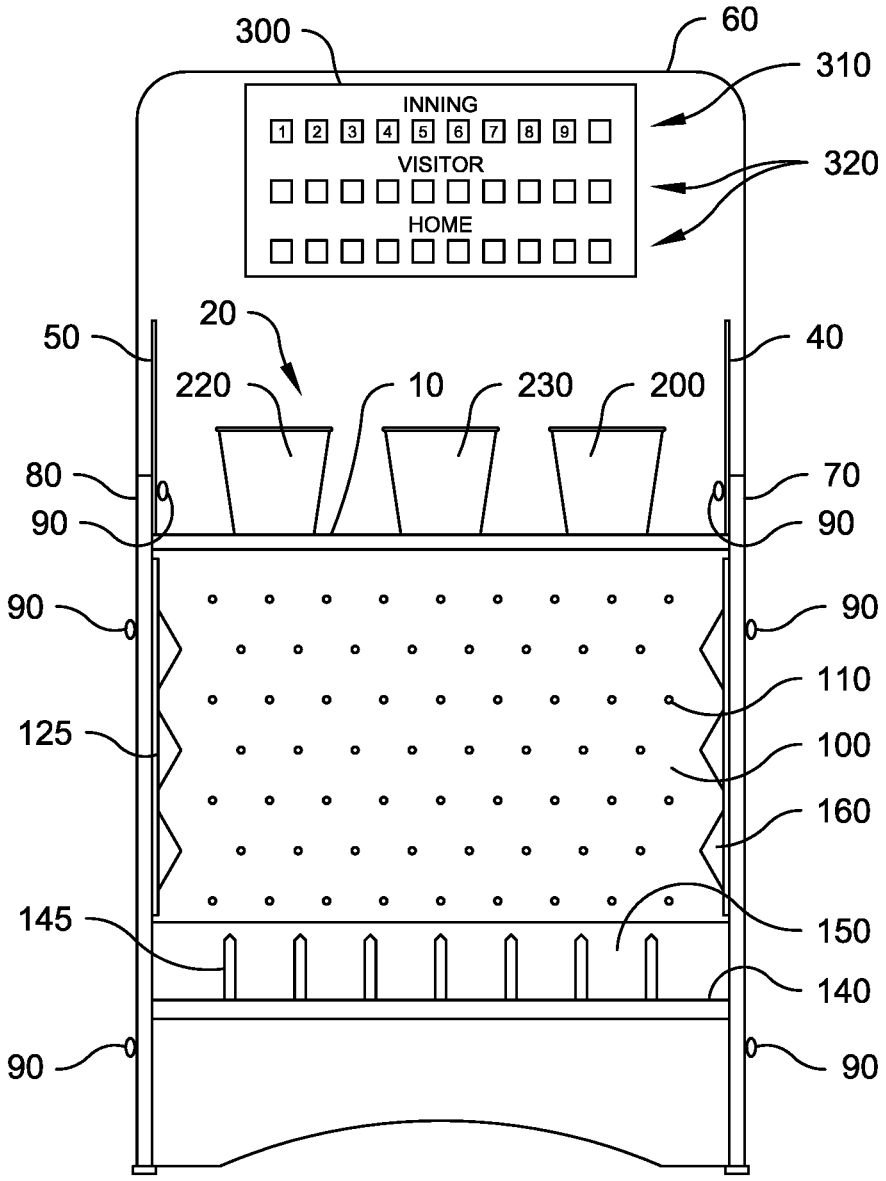
FIG. 3 shows a front elevational view of a portable indoor-outdoor board game with baseball theme according to the invention.

The game may be sports themed and rules of game play may vary reflecting key elements of a particular sport. For instance, the game may be themed baseball, football, golf or other sports. The game may also be non-sports themed. A baseball theme is demonstrated in the figures. As shown in FIGS. 1-3, playing surface 10 is themed with a baseball theme with a layout of a baseball field containing positions for first base 200, second base 210, third base 220, and home plate 230. The playing surface contains holes into which cups 20 may be placed at the base positions and at home plate. The dowel panel holder 100 is positioned at the front edge 15 of the playing surface not extending higher than the playing surface. Right containment panel 40 and left containment panel 50 may be positioned on right and left sides of the playing surface in order to contain any balls which may bounce if they do not fall into one of the cups. Rear side panel 60 may be positioned at the back of the playing surface and may extend above the playing surface also serving to contain balls. Right containment panel 40 may be attached via screws or other means to right side panel 70, and left containment panel 50 may be attached in a similar manner to left side panel 80.

In a preferred embodiment, the playing surface 10, right 40 and left 50 containment panels, and rear side panel 70 may be padded to assist in containing the ball and reducing excessive bounce in the event that the ball misses any of the cups. The balls may be standard ping pong balls. Alternately, the balls may be constructed of a heavier material to prevent excessive bouncing and to contain the ball during game play.

Rear side panel 60 may also contain a means of recording the score during game play. For instance, in the baseball theme, rear side panel may contain a scoring panel insert 300 with areas to indicate the inning of play 310 and players scores, or points awarded (runs in the baseball theme) 320, during each inning. The scoring panel insert may be constructed of a material which allows rapid entries and changes as the game progresses. For instance, the scoring panel may be metallic, white board or other material which allows innings and scores to be readily updated. In the case of a metallic scoring panel, magnets may be placed to mark the inning, and numbered magnets may be placed to designate each player's scores obtained in each inning. In a white board construction, scores and inning designations may be written and changed as necessary with an appropriate pen as the game progresses.

Figure 4:
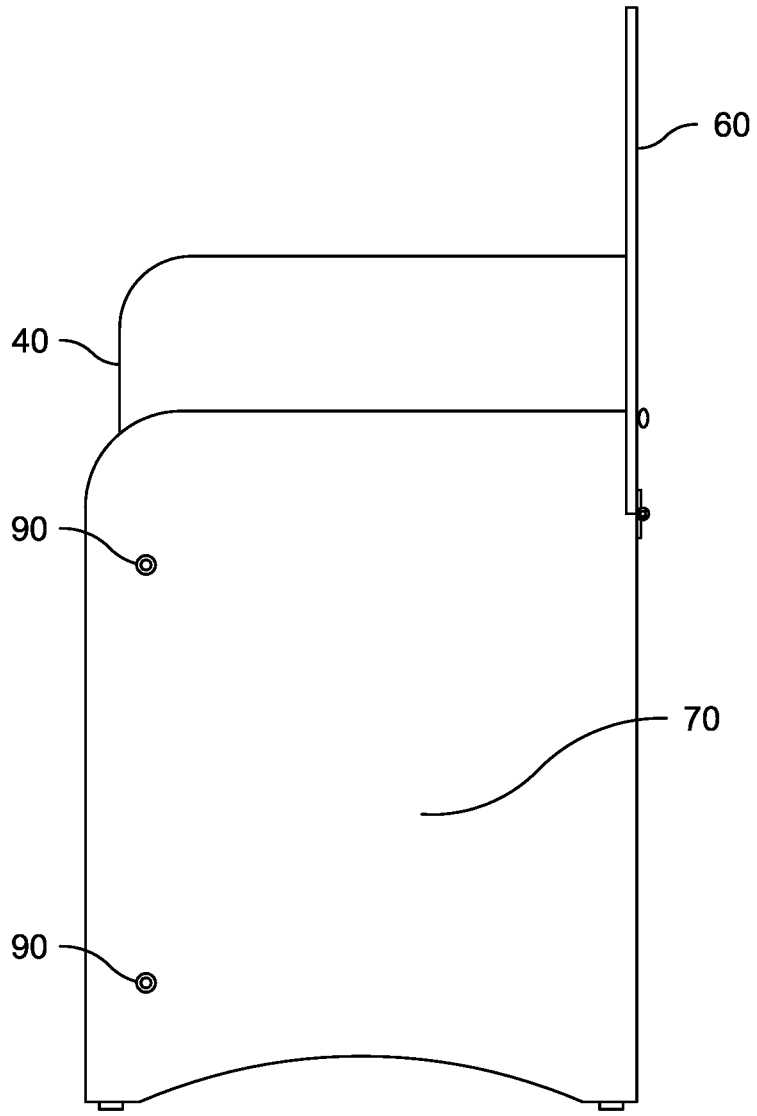
FIG. 4 shows a right side elevational view of a portable indoor-outdoor board game with baseball theme according to the invention.
Figure 5:
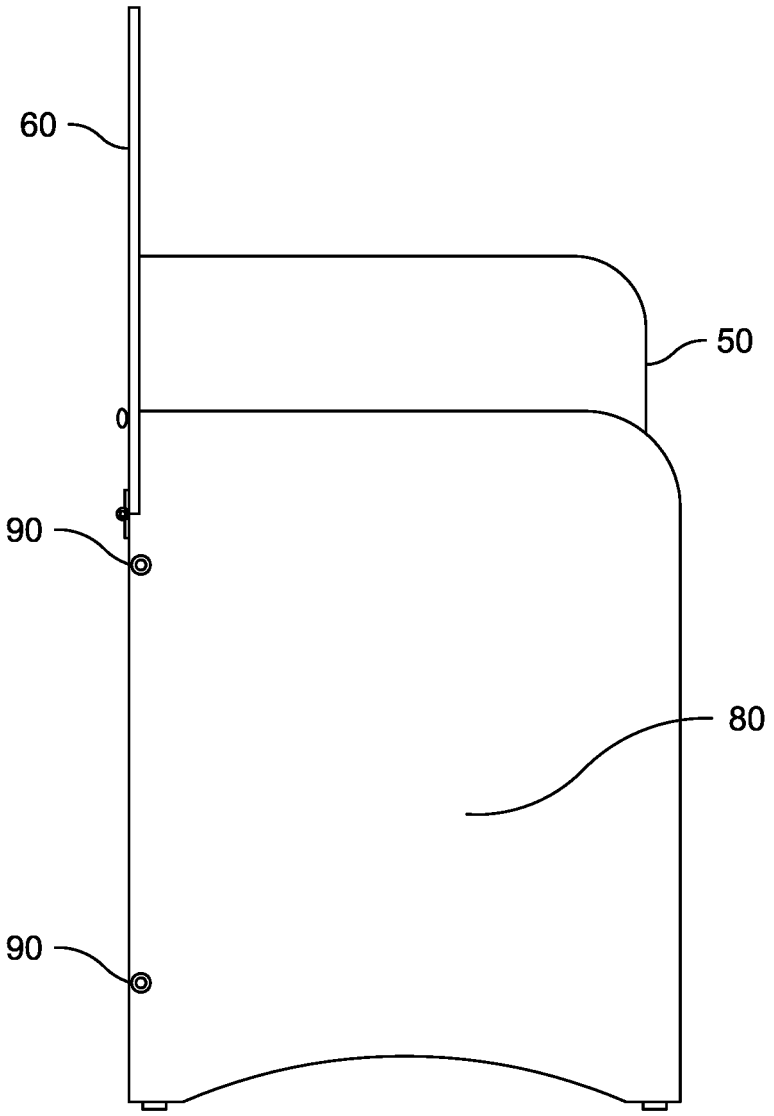
FIG. 5 shows a left side elevational view of a portable indoor-outdoor board game with baseball theme according to the invention.
Figure 6:
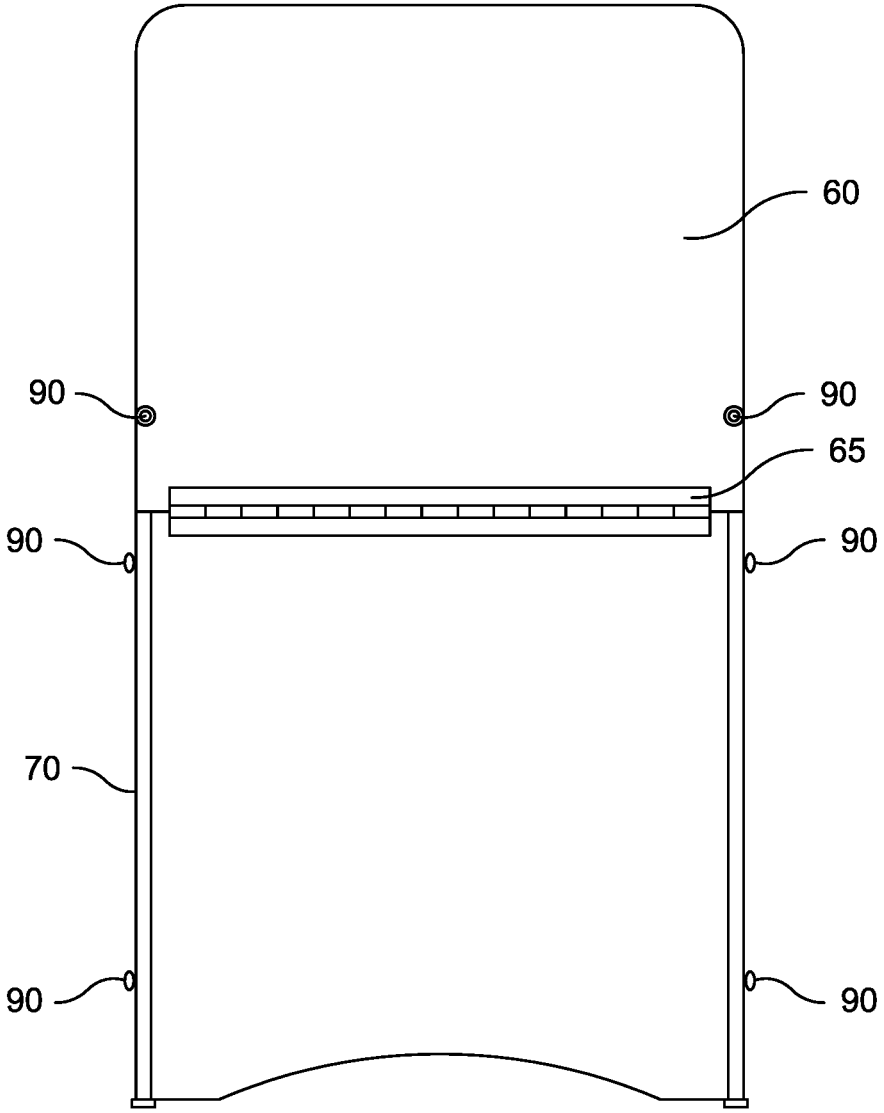
FIG. 6 shows a rear side elevational view of a portable indoor-outdoor board game with baseball theme according to the invention.

FIGS. 4-6 show right side elevational view, left side elevational view, and rear side elevational view of the game, respectively. Notably, the game of the invention may be disassembled and collapsible to allow for easy transport and storage. In a preferred embodiment, rear side panel 60 may contain a rear hinge 65 so that rear side panel may be folded into a smaller dimension. When hinged, rear side panel will contain two sections: a top portion and a bottom portion such that the top portion may be folded down during disassembly of the game. In a similar manner, right side panel 70 and rear side panel 60 may be hinged to fold together, and left side panel 80 and dowel panel holder 100 may be hinged to fold together. Screws 90 may be used to secure front dowel panel holder 100 and right side panel and in a similar manner, thumb screws may secure left side panel to rear side panel.

Figure 7:
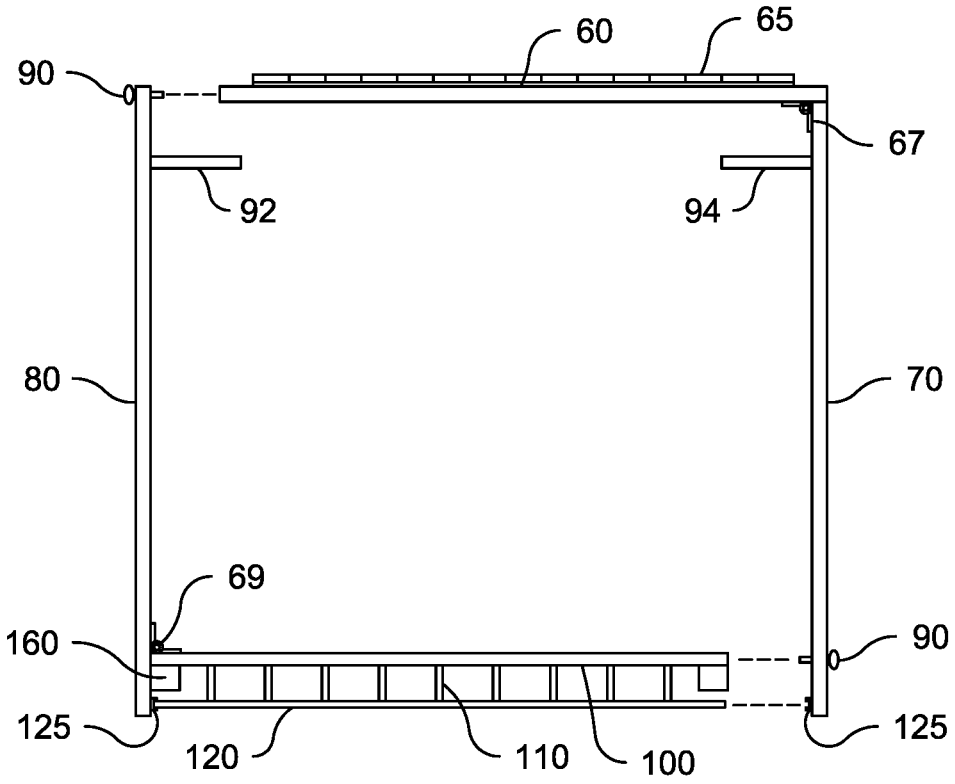
FIG. 7 shows a top plan view of a partially disassembled portable indoor-outdoor board game with baseball theme according to the invention.

FIG. 7 shows a partially disassembled game with the playing surface removed. As shown, rear side panel 60 and right side panel 70 may contain a right hinge 67 allowing these panels to fold for easy storage and transportation. In like manner, left side panel and dowel panel holder 100 may contain a left hinge 69 allowing these panels to fold. Playing surface 10 is not shown in the figure. However, when positioned in the assembled game, playing surface may rest on left rear support 92 and right rear support 94 toward the rear of the playing surface, and the front of the playing surface may rest on the top edge of dowel panel holder 100. Left rear support 92 and right rear support 94 may be dowels embedded into left side panel and right side panel, respectively. Rear side and right side panels are shown disassembled from left side panel and dowel panel holder and broken lines depict the attachment locations of the panels. The panels may be connected with screws 90 or other attachment means. Right containment panel 40 and left containment panel 50 are also not shown in FIG. 7.

Figure 8:
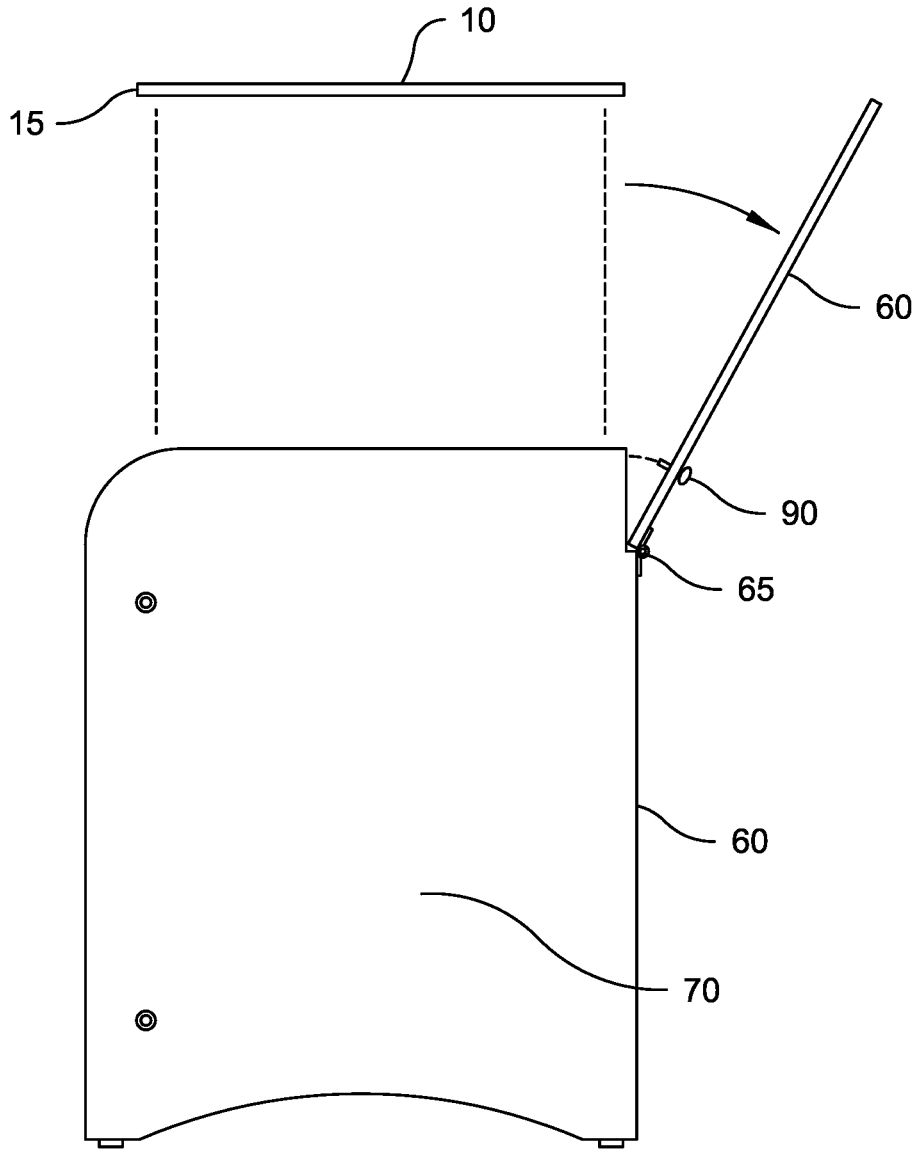
FIG. 8 shows a right side elevational view of a partially disassembled portable indoor-outdoor board game with baseball theme according to the invention.

FIG. 8 shows a right side elevational view of a partially disassembled game. Right containment panel 40 and left containment panel 50 are removed and not shown. Playing surface 10 is shown removed from the game, and broken lines depict the locations at which playing surface may be lowered into position on the game. An arrow shows the direction of movement of the top portion of rear side panel 60 as it is folded for storage. Screws may attach the top portion of rear side panel to the right side panel and left side panel when assembled, and a broken line depicts the attachment location on the right side.

The layout and appearance of playing surface 10 and scoring panel insert 300 may be changed to accommodate a variety of different games. The bottom of the game may contain adjustable feet to alter the height of the game and keep it level. Built in leveling beads and adjustable leveling feet may screw into right side panel 70 and left side panel 80 in order to properly level the game during set up.

Game Play with Baseball Theme

In practice, individuals or teams may play the game for an agreed number of innings, preferably nine innings. During an inning each individual or team will have the opportunity to throw the ball from a specified distance toward the cups. The object is to sink the ball into the field cups, scoring as many runs (points) as possible before recording a specified number of outs in the inning. In a preferred embodiment, if a player records three outs, his turn is finished and play passes to the other player. If a player misses a cup it is recorded as an out. If a player misses the playing surface entirely or if the ball bounces off the playing surface but does not go into the dowel panel holder, two outs are recorded.

Cups are placed on the playing surface to correspond to a baseball diamond with a cup at first base, second base, third base and home plate. When throwing, if a ball goes in the first base cup, the player records a single, and the player may mark the position of a "runner" on first base. Any other runners on the bases will advance one base. If the player throws a ball into the second base cup, the player records a double, he may mark the position of a runner on second base, and any other runners on the bases will advance two bases. In a similar manner, if the player throws the ball into the third base cup, he may mark the position of the runner on third base for a triple, and any runners already on base score a run(s).

If a player throws a ball into the home plate cup for the first time in an inning, it is recorded as a "base on balls" meaning that the player can mark the position of a runner on first base, and any runners currently on the bases may advance by one base if they are "forced," i.e. there is a runner on each base behind a particular runner, and advancement of the runners behind that runner, will "force" the runner to the next base. For instance, if a runner is marked on second base, and the player throws a ball into the home plate cup, the player will then have a runner on first base and second base. The player on second base will not advance as there were no runners behind him to force him to third base. However, if there are runners on first base and second base, and the player throws a ball into the home plate cup for a base on balls, the player can mark a runner on first base (the runner that received the base on balls), can mark a runner on second base (the runner on first base was "forced" to second base), and can mark a runner on third base (the runner on second base was "forced" to third base). For each runner advancing past home plate a run is scored and recorded.

If the player throws a ball into the home plate cup for the second or subsequent time in an inning, it is recorded as a home run. All runners on the bases, and the "runner" that scored the home run will advance. For instance, if the player had a runner on second base and another runner on third base, and then threw the ball into the home plate cup for the second or subsequent time in an inning, he would score three runs: two for the runners on second and third bases and one for the runner who was represented hitting the home run. After all runs are scored the bases are cleared, i.e. no runners remain on the bases, and play continues.

Score cards in the shape of a baseball diamond with positions for first base, second base, third base and home plate may also assist in keeping track of the positions of the runners and runs scored during a particular inning. In a preferred embodiment, the cards may be magnetic so that the positions of runners may be easily updated.

As noted previously, any missed shot that stays in the field of play, i.e. on the playing surface, is recorded as an out (or two outs if the players misses the playing surface or the ball bounces off the playing surface). However, if the player does not incur the requisite number of outs to end play, typically three outs, after missing a cup, play continues, and the player may continue to gain rewards or incur penalties in the "chance" portion of the game. If a player incurs the requisite number of outs, typically three, after missing a cup, the inning is over for that player even if the ball continues to roll off the playing surface and down into a compartment.

Any ball which misses a cup will roll toward the front edge of the playing surface as the playing surface is sloped. The ball will then drop off the front edge of the playing surface, into the pegs, and finally into the compartments where the player may obtain greater benefits (runs or hits) or incur additional penalties such as additional outs. The compartments may contain designations such as single, double, triple or home run. If a ball lands in these compartments, he may place a runner on first for a single, a runner on second for a double, a runner on third for a triple, or move his runner around all of the bases for a home run. Correspondingly, any runners that were already on the bases will move forward one base for a single, two bases for a double, and three bases for a triple. A home run clears the bases, i.e. all runners, including the one hitting the home run, will move forward and will score runs as they advance past home plate.

On the other hand, the compartments may contain penalty designations, for example, one or two outs. If a player incurs the requisite outs when the ball falls into a penalty compartment, typically three, the inning is over for that player. Once these outs are recorded for a player or team, play passes to the other player or team.

In a typical game of baseball, teams are designated as a home team or a visiting team depending on whose field the teams are playing. The visiting team always starts an inning batting (attempting to hit a pitched ball) while the home team fields and tries to record outs. After three outs are recorded, the teams switch and the home team bats while the visiting team fields. Accordingly, in an inning, the home team always bats last.

In game play of the subject invention, home and visiting teams may be determined by flipping a coin at the start of the game. In a preferred embodiment, players will throw balls from a throw line located at a distance from the game equipment. Preferably, the distance from the throw line and the game is six feet for adults and four feet for children. The player's hand is not permitted to cross the throw line or an automatic out will be called.

Play continues as described herein, with players throwing the ball to score runs each inning until the predetermined number of outs, typically three, are recorded against them. Then the other player has the opportunity to throw the ball and score runs. Players alternate turns throwing the balls for a specified number of innings, preferably nine. The player or team with the most runs after nine innings wins the game. If score is tied after nine innings, extra innings can be played until one player or team scores more runs than the other. The game winner is the highest scoring individual or team determined by the number of runs that the individual or team scores during the game.

The invention has been disclosed in terms of preferred embodiments which fulfill all of the objects of the present invention and overcome the limitations of the prior art. It will be understood that each of the elements described above, or two or more together, may also find useful application of other types or methods differing from the types described above. Various changes, modifications, and alterations from the teachings of the present invention may be contemplated by those skilled in the art without departing from the intended spirit and scope thereof. It is intended that the present invention only be limited by the terms of the appended claims.

I claim:

1. A portable indoor-outdoor board game comprising:

A sloped playing surface with at least one cup positioned within the playing surface, the playing surface having a front edge and the playing surface being sloped toward the front edge, A dowel panel holder positioned generally perpendicular to the playing surface and below the playing surface, the dowel panel holder containing a plurality of pegs alternately arranged between a front dowel panel and the dowel panel holder and sized to permit passage of a ball through the pegs, and A compartmentalized tray positioned at the bottom of the dowel panel holder containing at least compartment.

2. The portable indoor-outdoor board game of claim 1 further comprising a right side panel, a left side panel, and a rear side panel connected to the playing surface and the dowel panel holder.

3. The portable indoor-outdoor board game of claim 1 further comprising at least one side panel positioned generally perpendicular to the playing surface and above the playing surface, the at least one side panel selected from the group consisting of a right containment panel, a left containment panel, and a rear side panel, to contain the ball thrown in the direction of the playing surface.

4. The portable indoor-outdoor board game of claim 1 further comprising at least one deflector to direct the ball in the direction of the pegs.

5. The portable indoor-outdoor board game of claim 1 whereby the front dowel panel is transparent.

6. The portable indoor-outdoor board game of claim 2 further comprising a track attached to the right side panel and a track attached to the left side panel, each track configured to receive and removably secure the front dowel panel.

7. The portable indoor-outdoor board game of claim 1 further comprising at least one divider positioned within the compartmentalized tray to create the at least one compartment.

8. The portable indoor-outdoor board game of claim 1 whereby the playing surface is padded.

9. The portable indoor-outdoor board game of claim 2 wherein the rear side panel is magnetic or white board and contains indicia for recording points.

10. The portable indoor-outdoor board game of claim 2 wherein the right side panel, the left side panel, the rear side panel, the playing surface, and the dowel panel holder are removeable and foldable for compact transport and storage.

11. The portable indoor-outdoor board game of claim 2 further comprising a left rear support attached to the left side panel and a right rear support attached to the right side panel to removably support the playing surface.

12. The portable indoor-outdoor board game of claim 1 whereby a top edge of the front dowel panel is raised above the level of the playing surface.

* * * * *